United States Patent [19]

Kotski

[11] 4,230,389

[45] Oct. 28, 1980

[54] FLEXIBLE ELECTRICAL CONNECTOR ASSEMBLY

[75] Inventor: Edward J. Kotski, Hackettstown, N.J.

[73] Assignee: Amerace Corporation, New York, N.Y.

[21] Appl. No.: 974,088

[22] Filed: Dec. 28, 1978

[51] Int. Cl.[3] ..... H01R 13/54; H01R 23/06

[52] U.S. Cl. ..... 339/75 M; 174/78; 174/88 S; 339/14 R; 339/49 R; 339/251

[58] Field of Search ..... 339/75 R, 75 M, 75 P, 339/28, 29 R, 14 R, 47 R, 251, 49 R, 49 B, 212, 102 R, 104, 92 R, 92 M, 116 R, 116 C, 76, 77; 174/78, 84 S, 88 S

[56] References Cited

U.S. PATENT DOCUMENTS

| | | | |
|---|---|---|---|
| 1,750,633 | 3/1930 | Farmer | 339/251 X |
| 2,855,577 | 10/1958 | Flower | 339/251 X |
| 3,576,939 | 5/1971 | Ziemek | 174/78 UX |
| 3,691,505 | 9/1972 | Graves | 174/78 UX |
| 3,701,839 | 10/1972 | Smith | 174/78 |
| 3,915,540 | 10/1975 | Thompson et al. | 174/78 X |

FOREIGN PATENT DOCUMENTS

| | | | |
|---|---|---|---|
| 1518001 | 2/1968 | France | 339/75 M |

*Primary Examiner*—Roy Lake
*Assistant Examiner*—Eugene F. Desmond
*Attorney, Agent, or Firm*—Richard A. Craig; Ken Richardson

[57] ABSTRACT

An electrical connector and cable assembly comprising a predetermined length of cable and a pair of opposed flexible connector sections at each end thereof adapted to be separably engaged respectively with corresponding flexible connector sections on other connector cable assemblies to form an electrical cable of required size. Each opposed flexible connector section includes electric contact members connected to a live conductor or a plurality of live conductors in its associated cable with the contact members being adapted to engage complementary contact members in a connector section associated with another cable to form a connector assembly therebetween when the sections are matingly engaged thereby joining the live conductors together. A flexible ground strap is spirally wound or wrapped about the complementary engaged sections after joinder thereof, the strap being disposed within a complementary spiral recess in the encasement formed by the engaged sections, and is then connected at each of its ends to the respective ground conductors in each section through corresponding terminals seated within the spiral recess.

6 Claims, 7 Drawing Figures

FLEXIBLE ELECTRICAL CONNECTOR ASSEMBLY

The invention relates generally to a novel electrical connector assembly especially suitable for separably coupling sections of an electrical power cable to produce a cable of desired length suitable for supplying electrical power in underground mining applications.

It has recently been proposed in underground mining applications to provide electrical power for mining equipment such as shuttle cars or coal loaders, for example, with a multiple conductor electrical power cable comprising a number of separable sections that are electrically joined to one another. A principal benefit derived from the use of such separable power cables is that they may quickly be repaired at the job site when damaged by merely replacing the damaged sections with a new one. An example of a separable electrical cable and connector assembly adapted to be employed in such manner is fully disclosed in co-pending U.S. patent application Ser. No. 914,081 filed June 9, 1978 assigned to the same assignee as the present application. As taught in U.S. patent application Ser. No. 914,081, these cable and connector assemblies must be of sufficient strength and flexibility to enable the assembled cable unit to be reeled in and out by a cable winding apparatus associated with the shuttle car or coal loader vehicle without failure of the connector joints. To this accomplishment, corresponding individual conductors associated with each cable section to be joined together, including the corresponding ground conductors, are provided in one preferred form with matable connector elements in the form of pin-shaped male contacts and/or complementary pin-receiving socket-shaped female contacts secured to respective elongated load-sustaining members. The elongate load sustaining member of each cable connector section is housed in an insulative sheath with the two sheaths being complementary and engageable with one another in a transverse direction to form a connector assembly electrically and mechanically joining two cable sections together. The required flexibility and tensile strength at the cable joint thus created are in part acquired as a consequence of these features.

In accordance with the present invention, however, it has been discovered that the cable joints created with these assemblies may be further improved by imparting: (1) greater magnitudes of flexibility without appreciable loss in tensile strength, (2) a more compact design, and (3) greater measures of protection from electrical shock when, briefly stated, the electrical connection between the corresponding ground conductors is formed by a flexible ground connector element disposed about the external surface of the complementary engaging sheaths internally encasing the connection between the corresponding live conductors.

It is therefore an object of the present invention to provide an improvement in flexible electrical connector assemblies.

It is yet another object to provide a separable electrical connector assembly, having increased flexibility, reduced size, and which affords an increased measure of protection against hazards such as electrical shocks.

It is still a further object to provide a separable electrical connector assembly adapted to join the conductors of a pair of power cables by means of a pair of interengaging sections forming an insulated encasement for such conductors and which includes a separable, flexible ground connector element spirally wrapped or wound about the engaged sections and connected to the wires in each cable to effect a flexible electrical connection between different sections of the power cable such that the cable joint thus created is of sufficient strength and flexibility to enable the power cable to be reeled in and out by a cable winding apparatus without failure occurring at the connector assembly.

To the accomplishment of these and additional objects and advantages, the present invention briefly described comprises a flexible ground connector element seated within a spiral-shaped recess disposed within the external surface of the sheath or housing forming the encasement of the connector assembly. Each end of the ground connector element has a terminal which is adapted to matingly engage a corresponding terminal seated within the recess and connected to a corresponding ground conductor in each connector section of the assembly. Other matingly engaged contact elements disposed interiorly within the assembly separably couple the corresponding individual live conductors of the different sections to one another.

The foregoing and still further objects and advantages will be made apparent from a study of the following detailed description of a preferred embodiment of the invention illustrated in the accompanying drawing, in which.

Figure 2:
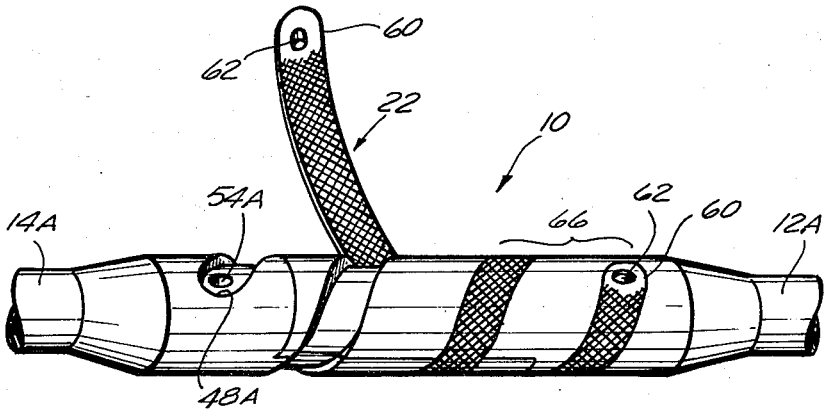
FIG. 2 is a perspective view of the electrical connector assembly of FIG. 1, in a partially assembled condition and showing the ground connector element partially installed thereon.
Figure 1:
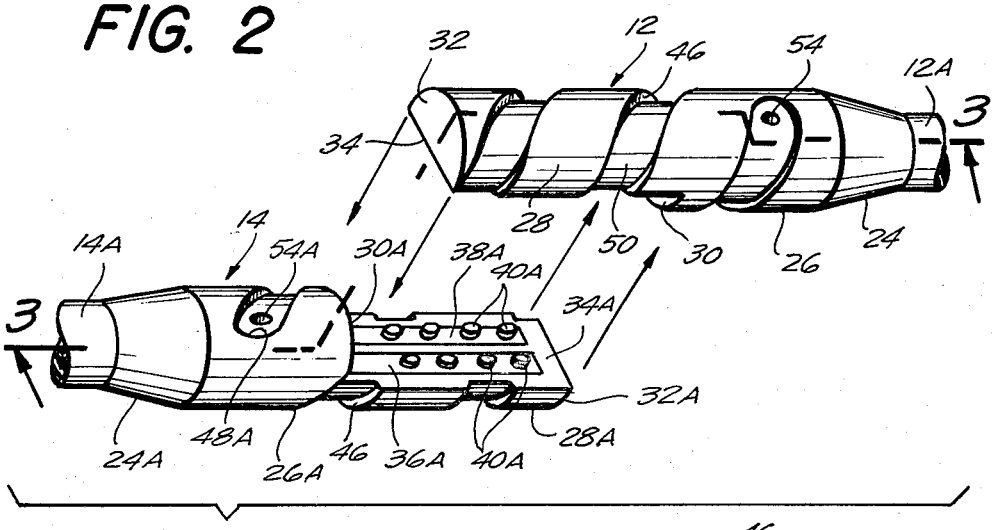
FIG. 1 is an exploded assembly view in perspective of a connector assembly according to the invention, but without the ground connector element installed thereon.
Figure 5:
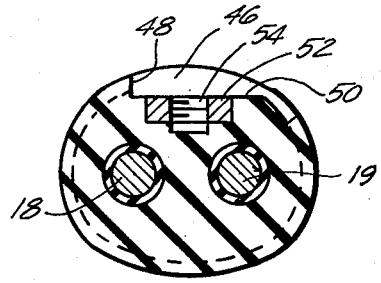
FIG. 5 is a sectional view taken along line 5—5 of FIG. 4.

Referring now to the drawing, and initially to FIGS. 1 and 2 thereof, there is shown an electrical connector assembly generally indicated by reference numeral 10 comprising first and second separable sections 12 and 14 for making a flexible electrical connection or cable joint between different sections 12A and 14A of an insulated multiple conductor power cable so as to obtain an assembled cable unit (not shown) of a required length substantially greater than the length of the individual cable sections suitable for supplying electrical power in underground mining applications. Thus, it will be understood that in a typical underground mining application the assembled cable unit comprises several joined sections 12A, 14A, etc. each of which terminates at one end in a connector section 12 and at its other end in a connector section 14. The entire cable unit may be connected to the winding reel assembly on a shuttle car or a coal loader whereas the remaining end thereof may be connected to a power station as is well-known in the art.

Figure 3:
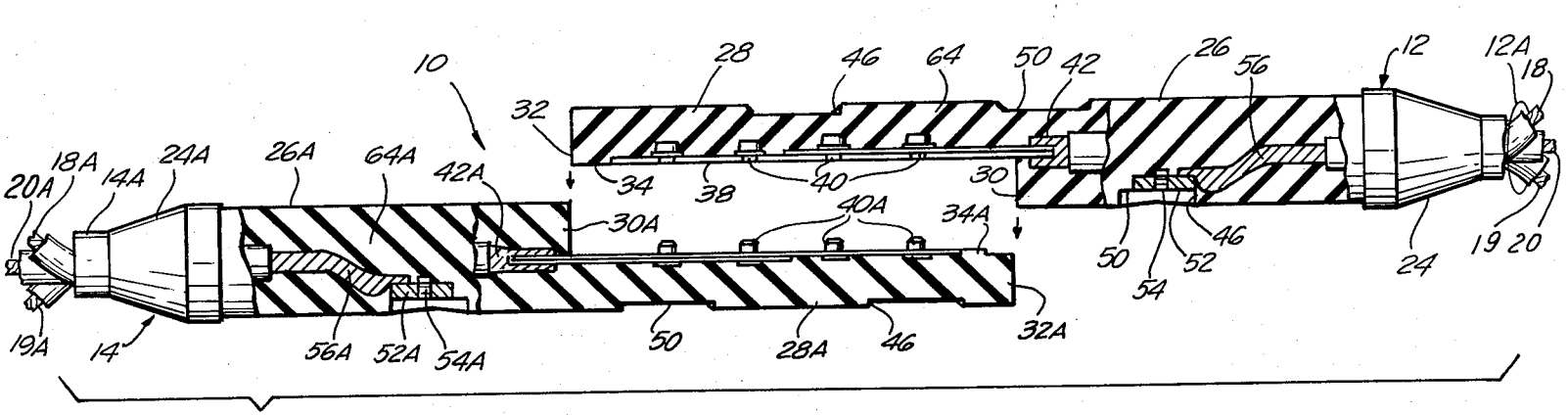
FIG. 3 is a sectional view of the assembly of FIG. 1 taken along line 3—3 of FIG. 1.

In practice, each preferred cable section may be provided in a convenient length such as one hundred feet, for example, and as schematically indicated in FIG. 3 may comprise three insulated conductors, two of which are live conductors 18 and 19 respectively, and the third of which is a ground conductor 20, each conductor 18, 19 and 20 being encased within a separate insulation jacket within the cable section as is well-known in the art.

In somewhat similar fashion to the flexible electrical connector disclosed in the aforementioned co-pending application, Ser. No. 914,081, the disclosure of which is incorporated herein by this reference, connector sections 12, 14 each include an elongate array of electrical contacts, the contacts of one section being cooperatively engageable with the contacts of the other section in a transverse direction. In accordance with the present invention, however, the electrical contacts are adapted to couple together only the live conductors in a pair of cables 12A, 14A, i.e., conductors 18,19 of cable 12A are connected to conductors 18A, 19A of cable 14A, with the ground conductors 20, 20A in this same pair of cables being connected via an external, spirally wrapped flexible ground connector strap 22 as will be more fully described below.

Figure 4:
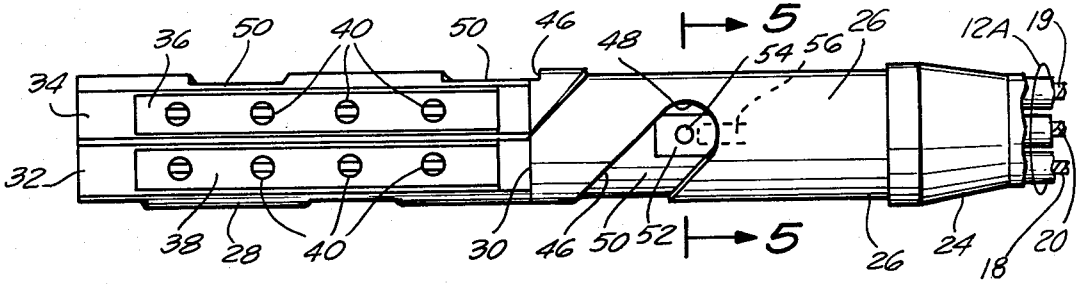
FIG. 4 is a plan view of the right hand section of the connector assembly of FIG. 2.

In the preferred embodiment of connector assembly 10, section 12 comprises a frusto-conical portion 24 adjacent cable 12A, an intermediate cylindrical portion 26 and a semi-cylindrical distal or end portion 28. A semi-circular flat end face 30 defines the end of intermediate cylindrical portion 26 whereas a semi-circular flat end face 32 likewise defines the end of distal portion 28. Extending between end faces 30 and 32 is a flat surface 34 on which is disposed substantially as shown in FIGS. 3 and 4 a pair of elongate tensile load sustaining members 36, 38 each of which carries a row of spaced female electrical contacts 40. The load sustaining members may electrically be connected to the stripped terminus 42 of each individual conductor 18, 19 by brazing them together.

Disposed within the exterior surface common to intermediate portion 26 and distal portion 28 is a portion of a spiral recess 46 which has one end terminating in an arcuate shaped wall surface 48 substantially as shown in FIG. 4. Embedded in the floor or bottom surface 50 of recess 46 proximal to wall surface 48 is a flat electrically conductive terminal member 52 having a tapped hole 54 centrally disposed therein. Terminal member 52 likewise may be electrically coupled to the stripped terminus 56 of ground conductor 20 of electrical power cable 12A by brazing them together.

Similarly, section 14 of connector assembly 10 comprises a frusto-conical portion 24A adjacent cable 14A, an intermediate cylindrical portion 26A and a semi-cylindrical distal or end portion 28A. A semi-circular flat end face 30A defines the end of intermediate cylindrical portion 26A whereas a semicircular flat end face 32A likewise defines the end of distal portion 28A. Extending between end faces 30A and 32A is a flat surface 34A on which is disposed substantially as shown in FIGS. 1 and 3 a pair of elongate tensile load-sustaining members 36A, 38A each of which carries a row of spaced male electrical contacts 40A adapted to cooperatively engage and mate with corresponding female contacts 40 of connector section 12. As in the latter part, the load-sustaining members 36A, 38A may electrically be connected to the stripped terminus 42A of each individual conductors 18A, 19A by brazing them together.

Disposed within the exterior surface common to intermediate portion 26A and distal portion 28A is the remaining portion of spiral recess 46 which has its other end terminating in an arcuate shaped wall surface 48A substantially as shown in FIGS. 1 and 2. Embedded in the floor or bottom surface 50 of recess 46 proximal to arcuate wall surface 48A is a flat electrically conductive terminal member 52A having a tapped hole 54A centrally disposed therein. Terminal member 52A likewise may be electrically coupled to the stripped terminus 56A of ground conductor 20A of electrical power cable 12A by brazing them together.

It may be appreciated from the foregoing that connector sections 12 and 14 are substantially identical to one another save for the different nature of the contacts 40 and 40A. As disclosed in my copending application, Serial No. 914,081, however, even the contacts may be similar, i.e., each section may contain load-sustaining members having a row of two male contacts followed by two female contacts, or may have a row M F M F. Accordingly, when the two connector sections are positioned as shown in FIGS. 1 and 3 and joined in a transverse direction relative to the elongate load-sustaining members 36, 38, 36A, 38A to form the partially completed connector assembly of FIG. 2, there is established a direct electrical connection between conductors 18, 19 in cable section 12A and conductors 18A,19A in cable section 14A via load-sustaining members 36, 38, female contacts 40, male contacts 40A and load-sustaining members 36A, 38A. Furthermore, transverse joinder of sections 12, 14 relative to a plane parallel to flat surfaces 34, 34A and whereupon flat end faces 32, 30A and 30, 32A are substantially in mutual abutting engagement results in a secure lap joint between these two sections 12, 14 with the lap-joined sections forming a substantially cylindrically shaped encasement as shown in FIGS. 2, 5, 6 and 7.

Figure 7:
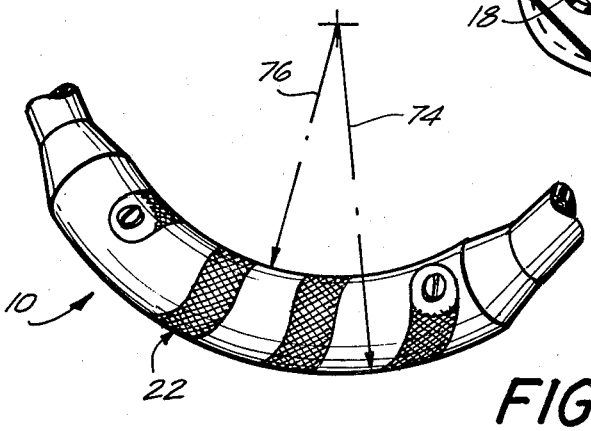
FIG. 7 is schematic depiction of the connector assembly of FIG. 1 in a flexed condition.
Figure 6:
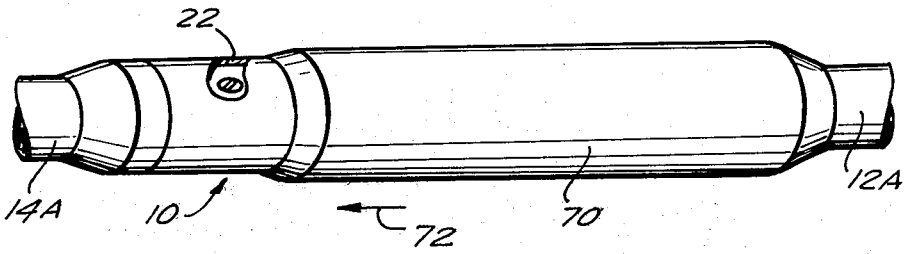
FIG. 6 is a perspective view similar to FIG. 1, but showing an outer protective jacket member being installed on the completed connector assembly.

Moreover, it will be noted that when the two sections 12, 14 are lap-joined together as described above and as shown in the drawing, recess 46 defines a continuous spiral path extending from ground conductor terminal 52 in section 12 to ground conductor terminal 52A in section 14 and vice versa. Spiral recess 46 which extends between the intermediate portions 26 and 26A of sections 12 and 14 has a depth and width sufficient to receive therein the ground connector element 22 which preferably is in the form of an elongated flexible strap member fabricated of an electrically conductive material such as copper braid, for example. Strap 22 is provided at each opposed end thereof with a substantially flat, paraboloid-shaped plate means or ear 60 also formed from a conductive material such as copper and permanently affixed to the braided portion of strap 22 in a convenient manner as by crimping or soldering. Ear 60 has secured thereto a terminal in the form of a screw-type fastener element 62 extending through an aperture therein for threadably connecting each end of strap 22 to terminal members 52, 52A via threaded apertures 54, 54A after the strap 22 has been emplaced within recess 46. Desirably the thickness of the strap 22 is such that the strap will not extend or protrude beyond the outer surface of the assembly 10 and preferably will be flush with said outer surface substantially as shown in FIGS. 2, 6, and 7.

Referring again to connector sections 12 and 14, these parts may be fabricated by first brazing the respective load sustaining members to the corresponding stripped terminal ends of live conductors 18, 19 and 18A, 19A.

Similarly, conductive terminals 52, 52A are brazed to the stripped ends of respective ground conductors 20 and 20A. The end of the cable 12A or 14A having these parts so connected thereto is then placed in a mold and a corresponding insulative protective sleeve or sheath 64, 64A, one for each cable section 12A, 14A, respectively, is molded thereabout in a known manner. Preferably, each sheath 64, 64A is of rubber material capable of being injection molded, such as neoprene rubber, for example. Of course, when it is desired to form a separable cable section, a predetermined length of cable will have connector section 12 formed on one end thereof and connector section 14 formed on the cable's opposite end.

In practicing the present invention, coupling of the two matable connector sections 12, 14 enables mutual engagement of electrical contact elements 40 and 40A, thus effecting electrical joinder of corresponding live conductors 18, 19 and 18A, 19A from each cable section 12A, 14A. Also effected is the alignment of the spiral recess portions in each section 12, 14 relative to each other, such that, they define the continuous spiral recess 46. Thus, spiral recess 46 begins at one of two regions 26, 26A positioned directly above one of the two terminal plates 52, 52A associated therewith, and ends at the remaining one of the two regions 26, 26A positioned above the remaining one of the two plates 52, 52A.

Relative to the longitudinal extent of assembly 10, the spiral path defined by recess 46 may be provided with either an integral number of one-half turns or coils 66 or with an integral number of full-turns, with the embodiment of FIG. 6 being shown with three full-turns. When an integral number of half-turns is employed, the same mold may be employed to produce each section 12 or 14.

As mentioned previously, recess 46 is of a depth and width to seat strap 22 preferably in a flush manner relative to the outer surface of each connector section 12, 14 so as to provide connector assembly 10 with a smooth continuous rounded substantially cylindrical shape. This smooth, continuous substantially cylindrical shape facilitates telescoping insertion of assembly 10 within an optional external protective electrically insulative tubular-shaped jacket 70. The latter may also be fabricated of a resilient material such as neoprene rubber and sized so that a slight interference fit exists between it and assembly 10 when the jacket is slid into position.

To complete the forming of the cable joint defined by assembly 10 subsequent to coupling sections 12, 14 to one another, strap 22 is next seated within recess 46 (FIG. 2) and operatively electrically coupled between corresponding ground conductors 20, 20A in cable sections 12A, 14A by fastening terminal screws 62 to plates 52, 52A via threaded holes at each end of the recess. External jacket 70 which, of course, was originally placed over one of the cable sections and moved away from the terminal end thereof to facilitate joinder of sections 12, 14, is then slid back in the direction of arrow 72 and into place over assembly 10 (FIG. 6).

It should be appreciated from the foregoing that the flexibility of the cable joint defined by connector assembly 10 is substantially improved without appreciable loss in tensile strength by obviating the need to connect the ground conductors in a pair of cables via elongate load-sustaining or contact carrying members encased internally within section 12 and/or 14, such being eliminated by the employment of an externally wrapped, flexible ground strap according to the present invention. Actually, the concentric structure of the spiral connection between ground conductors relative to the axial connection between live conductors provides additional strength or support to interconnected sections 12, 14. For example, in power cable applications where power cables are employed which do not have ground conductor components, strap 22 may still be connected and wrapped in a spiral manner between the coupled sections to provide the cable joint created by connector assembly 10 with additional holding strength at the joined sections. Of course, since no ground conductors are involved strap 22 may be constructed from a non-conductive material, such as nylon if desired.

Furthermore, by placing the ground connection on the outside of the splice assembly as taught herein, the size of the encasement necessary to insulate the load-sustaining members and their associated contacts is reduced thereby saving cost of manufacture and increasing the flexibility of the resulting joint.

The flexibility of assembly 10 at the cable joint created therewith is moreover, substantially enhanced by spiral recess 46 and flexible strap 22 disposed therein. To illustrate, as assembly 10 tends to deform or flex as depicted at FIG. 7 when subjected to bending forces acting thereon, an outer surface portion of flexed assembly 10, that is, the surface portion having the longer bending radius 74 relative to an inner surface having shorter bending radius 76, will attempt to stretch or lengthen, while an inner surface thereof will simultaneously attempt to compress or shorten. It has been found that when strap 22 is seated within spiral recess 46 such an arrangement substantially aids in allowing the outer assembly surface to stretch and the inner assembly surface to contract.

It will further be appreciated that forming the connection between corresponding ground conductors externally of coupled sections 12, 14 with flexible strap 22 minimizes electrical hazards such as electric shocks as the external ground connector behaves similar to an electrical shield. For example, if moisture should penetrate sections 12 or 14 and reach contact members 40 or 40A when energized, strap 10 would still safely reduce the effects of a potential shock as it is at ground potential and is electrically isolated from the connection between the live conductors 18,19 and 18A,19A upon being interposed in a spiral fashion between coupled sections 12, 14 on the one hand and jacket 70 on the other hand.

Although the preferred embodiment of the present invention has been described with reference to power cables each including two line conductors and one ground conductor, it will be understood that the principles of the invention are applicable to other forms of cable including more or less numbers of conductors.

Accordingly, it is desired that the subject invention be limited only by the spirit and scope of the appended claims.

I claim:

1. In an electrical connector assembly of a type for separably connecting sections of a multiple conductor power cable having first and second live conductors to produce a flexible power cable of required length, at least one live conductor of a first one of said sections being electrically connected to a corresponding live conductor of a second one of said sections with matable first and second electrical connector elements electrically connected to said first and second live conductors, respectively, comprising:

(a) first and second separable matable sections, said first and second sections being disposed about said first and second electrical connector elements, respectively, so as to allow an electrical connection therebetween when said first and second sections are joined together, each of said first and second matable sections having an exterior surface including a portion of a recess, said recess portions together providing, upon engagement of said matable sections with each other, said exterior surface of said connector assembly with a recess which is spirally shaped relative to the longitudinal axis of said matable sections; and (b) an elongate flexible braided strap for electrically connecting corresponding individual first and second ground conductors associated with said first and second sections, respectively, said strap adapted to be disposed in said recess and to be electrically connected between said corresponding first and second ground conductors .

2. In an electrical connector assembly as recited in claim 1 wherein said strap is provided with opposed ends with respective fastener means thereon for connecting said strap to a pair of corresponding terminals located in each of said first and second matable sections, respectively, in communication with each said recess portion respectively.

3. In an electrical connector as recited in claim 2, wherein each one of said terminals is flush mounted with respect to a floor of each said corresponding recess portion and is situated proximal to the extremity of each said corresponding recess portion.

4. The electrical assembly as recited in claim 3, wherein each said fastener means comprising a screw threaded terminal member and each of said terminals includes a complementary threaded aperture therein.

5. The electrical assembly as recited in claim 1 wherein said first and second matable sections are joined respectively to the opposite ends of a predetermined length of said multiple conductor power cable to form an individual separable connecting section of said power cable.

6. The electrical assembly as recited in claim 1 further including a protective jacket adapted to be telescopically displaced over said matable sections after said strap is electrically connected between said first and second ground conductors.

* * * * *